United States Patent [19]

Garcea

[11] 4,104,337

[45] Aug. 1, 1978

[54] MIXTURE FEED REGULATION DEVICE FOR AN INTERNAL-COMBUSTION ENGINE

[75] Inventor: Giampaolo Garcea, Milan, Italy

[73] Assignee: Alfa Romeo S.p.A., Milan, Italy

[21] Appl. No.: 819,565

[22] Filed: Jul. 27, 1977

[30] Foreign Application Priority Data

Aug. 4, 1976 [IT] Italy ..... 26015 A/76

[51] Int. Cl.[2] ..... F02M 1/10

[52] U.S. Cl. ..... 261/39 A; 123/119 F; 123/97 B; 261/52; 261/DIG. 19

[58] Field of Search ..... 261/39 A, 52, DIG. 19; 123/119 F, 97 B

[56] References Cited

U.S. PATENT DOCUMENTS

| | | | |
|---|---|---|---|
| 1,995,601 | 3/1935 | Browne | 261/39 A |
| 2,088,954 | 8/1937 | Gregg | 261/39 A |
| 2,264,869 | 12/1941 | Beardsley, Jr. | 261/39 A |
| 2,611,595 | 9/1952 | Streed | 261/39 A |
| 3,278,173 | 10/1966 | Cook et al. | 261/52 |
| 3,575,389 | 4/1971 | Goto et al. | 261/39 A |
| 3,791,358 | 2/1974 | Masaki et al. | 123/119 F |
| 3,934,571 | 1/1976 | Mennesson | 261/39 A |
| 3,956,433 | 5/1976 | Garcea | 123/119 F |

*Primary Examiner*—Tim R. Miles
*Attorney, Agent, or Firm*—Holman & Stern

[57] ABSTRACT

A device for correcting the mixture ratio of fuel vapors and air for an internal combustion engine is disclosed, which comprises pressure-sensitive members of the barometric sylphon-bellows type and means responsive to the engine temperature of the same type, said two responsive means being connected by a flex transmission means which is kept loose but becomes tightened under certain conditions, such as the last portion of the throttle-opening stroke. The device in question thus effects the correction of the mixture ratio by modifying the density of the air introduced in the engine intake duct.

3 Claims, 2 Drawing Figures

MIXTURE FEED REGULATION DEVICE FOR AN INTERNAL-COMBUSTION ENGINE

Figure 1:
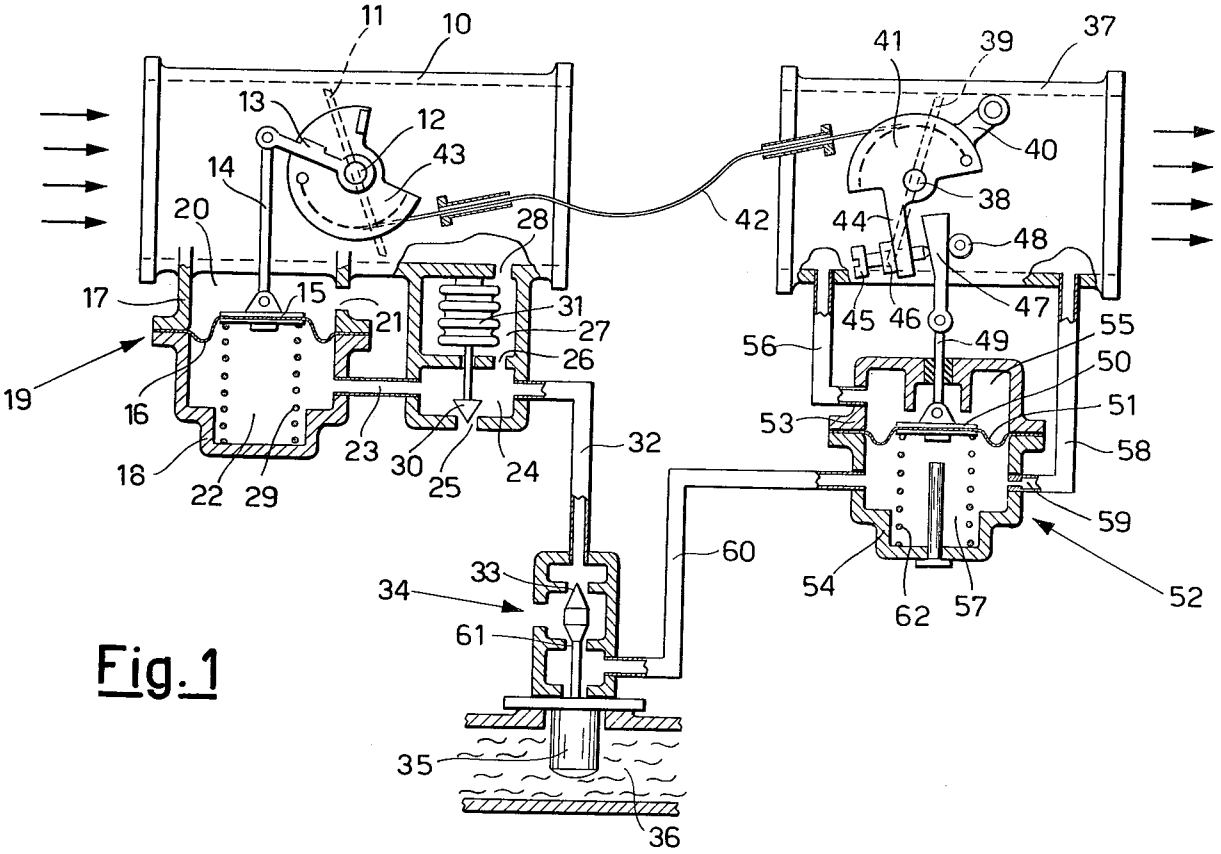

For the internal combustion engines it is known that it is extremely important to have a correct feed of the air-gasoline mixture, both from the point of view of the performances and to the end of restricting the percentage of pollutants in the exhaust gases, and also to the end of reducing fuel consumption.

To achieve this result, an accurate regulation is required of the mixture ratio and also of the rate of flow of the drawn-in mixture, not only under conditions of steady heat-exchange, but also during the transitional heat conditions of the engine and when the engine operates under environmental conditions which are different from the normal ones; a case in which feed corrections are required relative to the basic regulation.

A number of searches have been carried out, especially in the most recent years in order to solve the enginefeed problems under such particular working conditions, both in the case of injection feed and in the case of carburation feed, with the main object of providing automatic regulation devices.

However, the devices which have been suggested not always are in a position to carry out the corrections in the most appropriate way consistently with the engine requirements and, moreover, they are comparatively intricate in the majority of the cases, even though their field of action is restricted to a particular specific engine operation condition. A poor reliably is the result, since the possibility of incorrect operation and also of failures is increased.

The object of the present invention is to provide an automatic correction device which is comparatively simple as compared with the number of operations it is capable to perform, is accurate and is capable of being used both in injection fed engines and in carburationfed engines.

The device enables the mixture ratio to be automatically controlled along with the control of the rate of flow of the mixture which is drawn-in during the stage in which the engine has not yet attained its thermal equilibrium conditions, the control of the mixture ratio during the engine operation at high altitudes, and also the regulation of the rate of flow of the mixture which is drawn-in by the engine during the release of the accelerator pedal which is connected to the feed-throttling butterfly.

The device is based on the concept of regulating the mixture ratio by acting upon the specific gravity of the air drawn-in by the engine and is composed by means which are capable of varying such density or of keeping it constant in the different working conditions so as to control the weight rate of flow of the drawn-in air, and, thereby, the mixture ratio.

As a matter of fact, it is known that in the case of an engine fitted with a carburettor, the mixture ratio A/B is the ratio between the weight rate of flow of drawn-in air, $Q_A$, and the weight rate of flow of fuel, $Q_B$.

$$A:B = \frac{Q_a}{Q_B} = K \cdot \frac{\sigma A\, W_A\, \gamma A}{\sigma B\, W_B\, \gamma B}$$

wherein $K$ is a coefficient which takes into account the geometrical configuration of the feed system, $\sigma_A$ and $\sigma_B$ are the flow cross-sectional passage areas for air and fuel through the feeding system, $W_A$ and $W_B$ are the velocities of the air and the fuel through said passage cross-sectional areas and $\gamma_A$ and $\gamma_B$ are the specific gravities of air and fuel (it is recalled that the specific $\gamma$ gravity $\delta$ is bound to the density $\gamma = \delta g$, wherein $g$ is the gravity acceleration).

The above reported relationship can be further developed since the pressure drop air undergoes through the respective flow passage cross-sectional area, is the same to which the fuel is subjected through the respective flow cross-sectional area:

$$\frac{A}{B} = K \frac{\sigma A\, \gamma A \sqrt{\frac{\Delta P}{\gamma A}}}{\sigma B\, \gamma B \sqrt{\frac{\Delta P}{\gamma B}}} = K(n,\alpha) \sqrt{\frac{\gamma A}{\Delta B}}$$

wherein $K(n, \alpha)$ is a coefficient which is a function of the geometrical configuration of the carburettor and the working conditions of the engine, each characterized by two preselected engine parameters : $n$ = engine RPM, $\alpha$ = angle of the throttling butterfly.

On bearing in mind the relationship which binds the specific gravity $\gamma_A$, the pressure $p_A$ and the temperature $T_A$, which is : $\gamma_A \equiv P_A/T_A$, it can be seen that the environmental conditions have a bearing on the mixture ratio.

Under normal environmental conditions (pressure at zero altitude and average temperature of 15° C–20° C), the specific gravity of air $\gamma_A$ is virtually constant, as it is $\gamma_B$. The mixture ratio then takes predetermined values the entire field of operation of the engine throughout. This holds good both for carburettor-fed engines and injection-fed engines, inasmuch as the latter engines are fitted with a regulation device which provides to meter the fuel as a function of the engine parameters which have been preselected as indices of the engine working conditions.

Hence the idea of providing a device for correcting the mixture ratio, which is based on the idea of artificially modifying the specific gravity of the air drawn-in by the engine through the control of the pressure of the air itself. The device originates in the air stream drawn by the engine a pressure drop which is variable according to a preselected law, the selection being made consistently with the mixture ratio variation law one desires to reduce to practice. More particularly, the device permits to achieve an enrichment of the mixture drawn in by the engine during the heating stage which immediately follows a cold start, and also permits to prevent the alterations of the mixture ratio relative to the calibration value and which are a result of the variations of the environmental conditions. Among these, the most important are the enrichments of the mixture which are experienced in the operation at high altitudes due to the gradual reduction of the pressure of the ambient air. The device of this invention is capable of keeping constant at a preselected value, under the conditions of steady heat exchange, the pressure of the air drawn in by the engine and thus its specific gravity. Thus the mixture ratio remains constant irrespective of the environmental condition changes.

In addition, the device permits to regulate and more particularly to increase the rate of flow of air for the engine during the engine-heating stage and also, during operation, as the accelerator pedal is released, since the device is fitted with means which are capable of varying the degree of throttling of the butterfly or butterflies intended to throttle the feeding stream. It is known that an increase of the rate of flow of the drawn-in air for the engine is necessary during the warm-up stage so as to overcome the internal engine resistance forces and it has been ascertained that this is also an advantage during the accelerator release to as to increase the density of the mixture charge as drawn-in by the engine and to encourage a more complete combustion.

The device can be employed as outlined above both in an engine fed by a carburettor and in an engine fed by an ejector, provided, of course, that the injection regulating device is not based on the use of the feed pressure as the engine parameter. The device can be employed in either case with slight constructional changes, these latter being essentially a function of the different features of the two feed systems.

The device according to the present invention is characterized in that it comprises first valve means arranged in the duct through which the air drawn-in by engine flows, upstream of the conventional throttling valve means actuated by the driver by the agency of the accelerator pedal and arranged at the inlet of the engine-feeding ducts, a first diaphragm capsule in which said diaphragm is mechanically linked to said first valve means, a chamber of the capsule being in communication with the outside atmosphere, the other chamber of the capsule being in communication, through a calibrated bore, with the duct through which air flows downstream of said first valve means and being also in communication with the environmental air through a first variable-cross-section passageway as defined by valve means which are operatively connected to a member which is responsive to a pressure which is a function of the environmental pressure and through a second variable-cross-section passageway as defined by valve means operatively connected to a member responsive to the engine working temperature, resilient means engaging said diaphragm to balance the force due to the pressure differential on the diaphragm faces, the device further comprising stop means in engagement with said conventional throttling valve means, said stop means being capable of varying the end-of-stroke position of said conventional throttling valve means, said stop means being mechanically linked to the diaphragm of a second diaphragm capsule, a chamber of the capsule being in communication with the duct through which the air flows downstream of said first valve means, the other chamber of the capsule being in communication with at least an engine-feeding duct downstream of the conventional throttling means of the feed through a second calibrated bore and being also in communication with the outside atmosphere through a third variable-cross-section passageway as defined by valve means which are operatively connected with a member responsive to the engine working temperature, resilient means engaging said second diaphragm to balance the force due to the pressure differential between the diaphragm faces.

One of the main features of the device is its constructional simplicity as compared with the number of functions it is capable of fulfilling. At any rate, features and advantages of the invention will be better understood by examining the embodiment of the invention as shown by way of nonlimiting examples in FIGS. 1 and 2.

Figure 2:
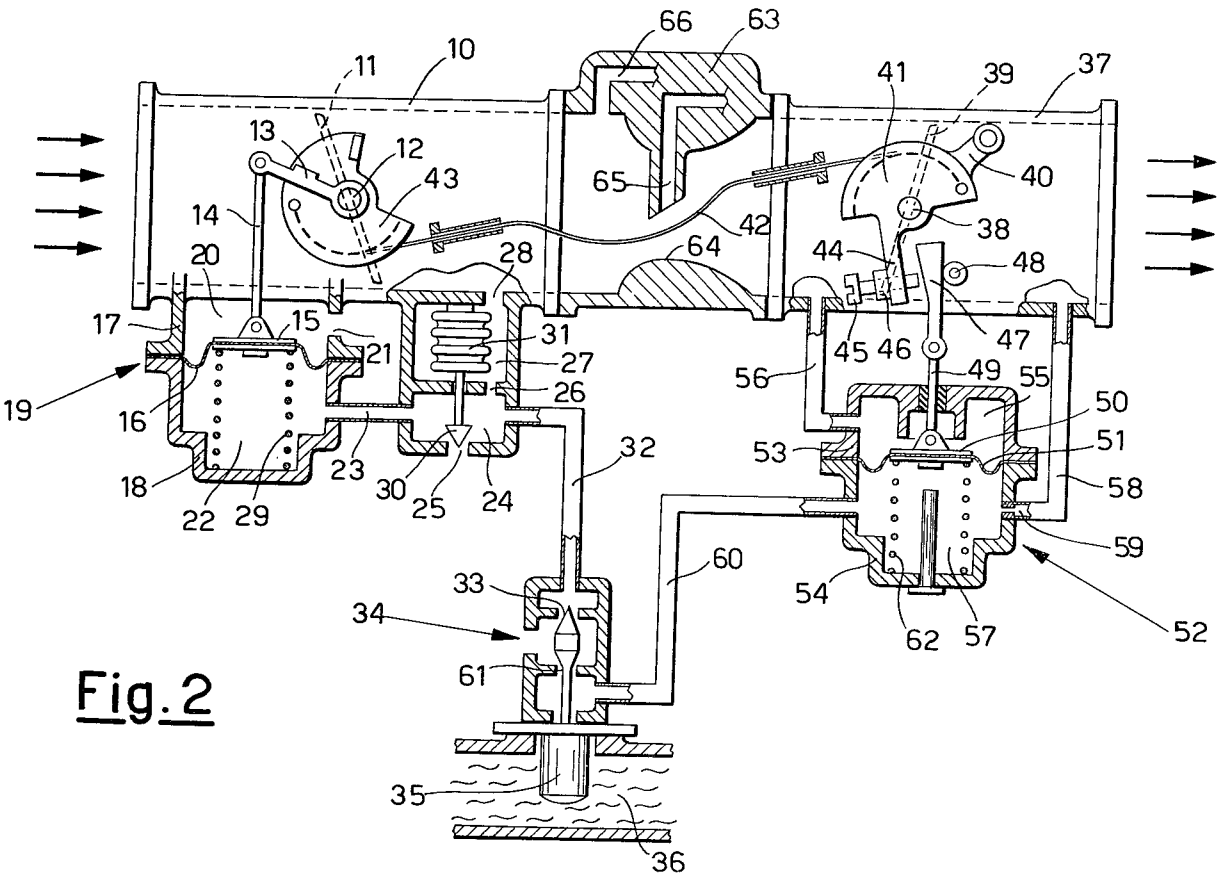

FIG. 1 shows the device of correction according to the invention in the embodiment which is suitable for an injection-fed engine, and FIG. 2 shows the same correction device in the version which is adapted to a carburation-fed engine.

FIG. 1 shows at 10 the duct through which the air drawn-in by the engine can flow and there is indicated at 11 a pre-throttle the arbor of which, indicated at 12, is supported for rotation by the duct 10 itself. The arbor 12 has, integral therewith, either end of a lever indicated at 13, whereas the other end of such lever is pivoted to the rod 14: the rod, in its turn, is pivoted to the plate 15 and the latter is solid with the central portion of a diaphragm shown at 16. The edge of the diaphragm 16 is fastened between the flanges of the two half-shells, 17 and 18, of a capsule generally shown at 19.

The chamber 20 of the capsule 19 is in communication with the outside atmosphere through the opening 21 and the chamber 22 of the capsule is connected through the duct 23 with the chamber 24: the latter chamber, in its turn, communicates with the outside atmosphere through the variable-cross-section passageway 25 and communicates through the calibrated bore 26 with the room 27 which, through the opening 28, freely communicates with the portion of the duct 10 downstream of the pre-throttle 11.

At 29 there is shown a highly yieldable spring, arranged in the chamber 22 of the capsule 19, to bias the diaphragm 16 and is capable of balancing the force originated by the pressure differential between its two faces.

The flow passage area of the passageway 25 is defined by a pin-valve 30 integral with the barometric sylphon bellows 31, which is housed in the room 27 and is affixed at either end to the wall of the duct 10.

The sylphon bellows 31 is sensitive to the pressure and its variations in the room 27 which, as outlined above, freely communicates with the area of the duct 10 which is downstream of the pre-throttle 11. Pressure decreases in the room 27 over the preselected pressure value cause the sylphon bellows 31 to elongate and consequential shifts of the pin 30 are experienced, in such a direction as to close the bore 25. Conversely, pressure increases in the room 27 aforesaid, cause the sylphon bellows 31 to shorten and the pin 30 undergoes such displacements as to open the passageway 25 wider. The chamber 24, in addition, is in communication with the outside atmosphere through the duct 32 and a second variable-cross-section passageway indicated at 33. The flow cross-sectional area of the passageway 33 is defined by either of the shutter elements of a pin valve 34 of the twin-taper type, which is integral with a member 35 responsive to the temperature of the engine, for example to the temperature of the liquid coolant flowing through the duct 36 (fragmentarily shown).

At 37 there is indicated the engine-feeding duct, to which the duct 10 is flangedly connected and in which the arbor 38 of the feed-throttling butterfly 39 is mounted for rotation.

To the arbor 38 of the butterfly 39 a lever, shown at 40, is solidly affixed, which is to be connected to the accelerator pedal (not shown). The same arbor 38 has, integral therewith, a circular sector indicated at 41, in which the guiding raceway of a Bowden flex cable 42, which is left slightly loose and connects with a certain clearance the sector 41 with a second circular sector, indentified at 43 and identical to 41, which is integral with the arbor 12 of the pre-throttle 11.

The circular sector 41 is fitted with an arm 44 which carries the screw 45 and the nut 46 for adjusting the end-of-stroke position of the throttle 39. The screw 35 engages a stop member, which is movable and is a wedge 47: the latter, in its turn, rests against a fixed abutment which is the roller 48. The wedge 47 is pivoted to the rod 49: the latter is pivoted, in its turn, to the dish 50 of the diaphragm 51 of a second diaphragm capsule, generally indicated at 52. The edge of the diaphragm 51 is sandwiched between the flanges of the two halfshells 53 and 54 of the capsule 52.

The capsule chamber, indicated at 55, is in communication, through the duct 56, with the section of the duct 37 which is upstream of the throttle 39. The other chamber of the capsule, shown at 57, is in communication, through the duct 58 and the calibrated bore 59, with the section of the duct 37 which is downstream of the throttle 39 and also communicates with the outside atmosphere via the duct 60 and the variable-cross-section passageway 61. The flow passage cross-section of the latter is defined by the second shutter element of the twin-taper pin valve 34.

When the engine is cold, the element 35 drives the shutter completely to open the port 33 and to close the port 61, whereas, when the engine is in thermal equilibrium, the contrary occurs, i.e. the port 33 is closed and the port 61 is fully open.

A very flexible spring, indicated at 62, is inserted in the room 57 of the capsule 52 and balances the force due to the pressure differential between the faces of the diaphragm 51.

Let the operation of the device described above be examined now as regards the control of the pressure of the air drawn-in by the engine as the altitude is varied.

Once that the value of the pressure of the drawn-in air has been established, that one desires to keep constant as the altitude is varied, the configuration of the sylphon bellows 31 is defined in terms of its elongation when the pressure in the room 27 and thus also in the duct 10 downstream of the pre-throttle 11 takes such a preselected value: consequently, variations of the pressure at the drawn-in air relative to such calibration value are such as to cause the sylphon bellows to become either stretched farther or contracted.

Consistantly with the configuration of the sylphon bellows 31, the flow cross sectional passage area of the port 25 takes different values and changes the ratio between said cross-sectional passage area and that of the fixed port 26. In the case in which the engine is in thermal equilibrium, inasmuch as the port 33 is closed by the pin valve 34, the pressure in the chamber 22 of the diaphragm capsule 19 takes different values, which are intermediate between the environmental outside pressure and the pressure in the duct 10 downstream of the pre-throttle 11, consistently with the ratio between the cross-sectional areas of the ports 25 and 26.

As the pressure in the room 22 is varied, the diaphragm 16, by virtue of the force (biassed by the springload) due to the pressure differential between its two faces, is displaced and brought to new equilibrium positions. The pre-throttle 11 is thus driven by the diaphragm 16 so as to uncover in the duct 10 different flow passages cross-sections for the air: more particularly, as the altitude is increased, the pre-throttle 11 is opened wider so that in the airstream a pressure drop is experienced which is decreased as the environmental pressure is decreased, such as to maintain the pressure in the duct 10 downstream of the pre-throttle 11 substantially constant at any altitude.

The control of the pressure of the drawn-in air as the altitude of operation is varied, permits to control the mixture ratio and forestalls the variations which would otherwise be experienced due to the changes of pressure and density of the ambient air as the altitude is varied.

Still with the engine in thermal equilibrium, the second diaphragm capsule 52 remains inoperative, the exception being that, under the condition of the accelerator pedal release, when the engine is hot, the port 61 is completely open and the pressure in the room 57 of the capsule 52, which takes a value intermediate between the ambient pressure and the pressure existing in the duct 37 downstream of the throttle 39, is not much below the atmospherical pressure, even if the pressure in the duct 37 downstream of the throttle 39 takes the reduced value which corresponds to the engine idling. Under such conditions, the diaphragm 51 is thrust upwards by the spring 62 and the wedge 47 inserts its minimum-thickness section between the fixed step 48 and the screw 45. Thus, with the engine idling, the throttle 39 is brought to its position of maximum closure.

Only during the stage of release of the accelerator pedal, in which the engine is still running fast, due to the closure of the throttle 39, the presence in the duct 37 downstream of the butterfly 39 itself attains so low a value that in the interior of the chamber 57 of the capsule 52, in spite of the opening of the port 61, the pressure is reduced by an amount which is enough to overcome the bias of the spring 62, so that the wedge 47 is urged downwards and the throttle remains wider open, in the position which corresponds to the so-called "fast idling". As the engine RPM diminishes below a certain value and tends towards the idling value, the pressure in the chamber 57 is increased anew until such time as the force due to the pressure differential between the diaphragm faces is no longer capable of overcoming the spring bias and the wedge 47 is thrust upwards again and enables the throttle 39 to be brought to its position of minimum aperture which corresponds to the engine idling condition.

Between the throttle 39 and the pre-throttle 11, a mechanical linkage has been provided, which is composed by the Bowden flex cable 42 which is slightly loose so that during the major fraction of the opening angular stroke of the throttle, the pre-throttle is capable of an independent motion: only in the last portion of the throttle opening stroke, the pre-throttle becomes solidly linked to the throttle and both are rotated in unison: thus, the pre-throttle is driven to become open beyond the position as determined by the diaphragm capsule 19.

At full engine power, the pressure correction is thus put out irrespective of the operation altitude of the engine and the pressure of the drawn-in air is the same atmospherical pressure or is close to it. By this expedient the density of the drawn-in air is higher than that which would have obtained if the correction mechanism had not been put out: this amounts to an advantage since a better filling of the engine is achieved, concurrently with and increase of the delivered power.

As outlined above, the device is also capable of controlling the mixture ratio with a cold engine, during warm-up, still through the regulation of the density of the drawn-in air.

When the engine temperature is below the thermal steady condition temperature, the element 35, which is deformed as a function of the engine temperature, drives the pin valve 34 to open the port 33 and to close the port 61. Thus, the chamber 22 of the capsule 19 is caused to communicate with the outside atmosphere through the room 24 in addition to the port 25 (which enters action when carrying out the altitude correction) and also through the additional port 33: the pressure in the room 22, which, as outlined above is at an intermediate value between the atmospherical pressure and the pressure obtaining in the duct 10 downstream of the pre-throttle 11, is increased relative to the case in which the port 33 is closed and tends closer to approach the atmospherical pressure.

The pre-throttle 11 is thus controlled by the diaphgram 16 to narrow so that an increased pressure differential is caused to occur in the air stream: the diminished density of the drawn-in air which is a result of this fact causes an automatic enrichment of the mixture sent to the engine. The magnitude of such an enrichment is a function of the degree of closure of the pre-throttle 11, that is to say that, by virtue of what has been said above, of the passage flow cross-sectional area of the port 33 and of the temperature of the engine, but such a magnitude is constant irrespective of the variations of the rate of flow of the drawn-in air.

Under these conditions the other port 61 controlled by the pin valve 34 is closed and thus in the room 57 of the diaphragm capsule 52 the same pressure is established which exists in the feed duct 37 downstream of the throttle 39 and such a pressure is sufficiently reduced as to originate on the diaphragm 51 a force which counteracts the bias of the spring 62 and causes the depression of the wedge 47, so that the butterfly 39 is driven to become partially open and is capable of supplying the engine with the rate of flow of air which is sufficient to overcome the internal frictional forces and to develop a self-sustaining feed power.

In the alternative embodiment of the device as shown in FIG. 2, which is adapted for a carburettor-fed engine, all the component parts which have already been shown in FIG. 1 are present and thus they have been indicated with the same reference numerals: in addition, the duct 63 can be seen, which on a side is flanged to the duct 10 and on the other side is flanged to the duct 37.

The duct 63 is fitted with a Venturi 64, in the restricted cross-section of which opens the jet 65 which dispenses the fuel to feed the engine at average and high power deliveries.

Through the wall of the same duct 63 there is also formed a small duct, indicated at 66, which is arranged upstream of the Venturi 64 and is connected to the venting duct of the carburettor cup (not shown) and is also connected to the air brakes for the fuel jets.

The device operates very much in the same way as that shown in FIG. 1: in this case, since a carburettor feed is involved, in which the delivery of the fuel jet is a function of the pressure differential to which the jets are subjected, there is transferred to the ceiling of the carburettor cup and to the air brakes the same controlled pressure of the drawn-in air, that is the pressure which is variable according to a preselected law of variation during the engine warm-up, so that the rate of flow of fuel varies consistently with the trend of the pressure of the drawn-in air and a preselected law of variation of the mixture ratio is achieved, along with the virtual constancy of the pressure irrespective of altitude changes, so that fluctuations of fuel feed are prevented, which would have been caused by the variations of the environment pressure as the altitude is varied and an accurate control can be obtained of the mixture ratio.

I claim:

1. A device for the regulation of the feed of mixture in an internal combustion engine when operating at high altitudes during the engine warm-up stage and the accelerator pedal release stage, characterized in that it comprises first valve means arranged in the duct through which the air drawn by the engine flows upstream of the usual valve throttling means actuated by the driver through the accelerator pedal and arranged at the inlet of the feeding ducts of the engine, a first diaphragm capsule in which the diaphragm is mechanically linked to the first valve means aforesaid, a chamber in the capsule being in communication with the outside atmosphere, the other chamber of the capsule being in communication, through a calibrated port, with the duct through which air flows downstream of same first valve means and being also in communication with the outside atmosphere through a first variable-cross-section port as defined by valve means operatively connected to a member responsive to a pressure which is a function of the ambient pressure and through a second variable-cross-section port defined by valve means operatively connected to a member sensitive to the engine working temperature, resilient means in engagement with said diaphragm balancing the force due to the pressure differential on the diaphragm faces, the device further comprising stop means in engagement with said throttling value means, said stop means being capable of varying the end-of-stroke position of said usual throttling valve means, said stop means being mechanically linked to the diaphragm of a second diaphragm capsule, a chamber of the capsule being in communication with the duct through which air flows downstream of said first valve means, the other chamber of the capsule being in communication with at least an engine-feeding duct downstream of the usual feed-throttling means through a second calibrated port and being also in communication with the outside atmosphere through a third variable-cross-section port as defined by valve means operatively connected with a member responsive to the engine working temperature, resilient means in engagement with said diaphragm balancing the force originated by the pressure differential on the diaphragm faces.

2. A device according to claim 1, characterized in that said stop means are composed by a wedge-like member.

3. A device according to claim 1, characterized in that said first valve means are operatively connected with said usual throttling valve means through connection means which makes them integrally connected to one another during the opening stroke of the same usual throttling means in the vicinity of the position of widest opening of the latter.

* * * * *